United States Patent [19]

Dunlap

[11] 4,326,393

[45] Apr. 27, 1982

[54] DECORATIVE FOOTLET-TYPE SOCK

[75] Inventor: Albert R. Dunlap, Mount Airy, N.C.

[73] Assignee: Brown Wooten Mills, Inc., Burlington, N.C.

[21] Appl. No.: 83,255

[22] Filed: Oct. 10, 1979

[51] Int. Cl.[3] ..... D04B 9/46

[52] U.S. Cl. ..... 66/172 E

[58] Field of Search ..... 2/239.61; 66/178 R, 66/41, 178 A, 171, 172 R, 172 E, 202, 190; 36/9, 10

[56] References Cited

U.S. PATENT DOCUMENTS

| | | | |
|---|---|---|---|
| 1,079,268 | 11/1913 | Scott | 66/172 |
| 1,192,801 | 7/1916 | Scott | 66/172 |
| 2,211,475 | 8/1940 | Nebel | 66/173 |
| 2,339,963 | 1/1944 | Pierre | 66/173 |
| 2,349,746 | 5/1944 | Morris | 66/172 |
| 2,953,003 | 9/1960 | Crawford | 66/173 X |
| 2,974,508 | 3/1961 | Westmoreland | 66/172 R X |
| 3,274,804 | 9/1966 | Thornburg et al. | 66/171 |
| 3,492,674 | 2/1970 | Poole | 2/239 |
| 3,990,115 | 11/1976 | Nester | 66/172 E X |
| 4,034,580 | 7/1977 | Holder | 66/172 E |
| 4,047,400 | 9/1977 | Thorneburg | 66/171 |
| 4,282,726 | 8/1981 | Wilkins | 66/172 E |
| 4,282,727 | 8/1981 | Dunlap et al. | 66/172 E |

*Primary Examiner*—Ronald Feldbaum

*Attorney, Agent, or Firm*—Charles R. Rhodes; Judith G. Smith

[57] ABSTRACT

A decorative surface for the exposed welt of a footlet-type sock is formed by knitting a plurality of successive courses of an elastic yarn and a synthetic or natural yarn in plated relationship. Each of the courses includes stitches formed and cast off in selected wales thereof separated by at least two successive float stitches, whereby the combination of the elastic yarn and the aforementioned knitting technique cause relatively wide bands or walewise ribs of raised or high relief fabric separated by relatively narrow bands of base fabric which exhibits a low relief area.

2 Claims, 3 Drawing Figures

Fig. 1
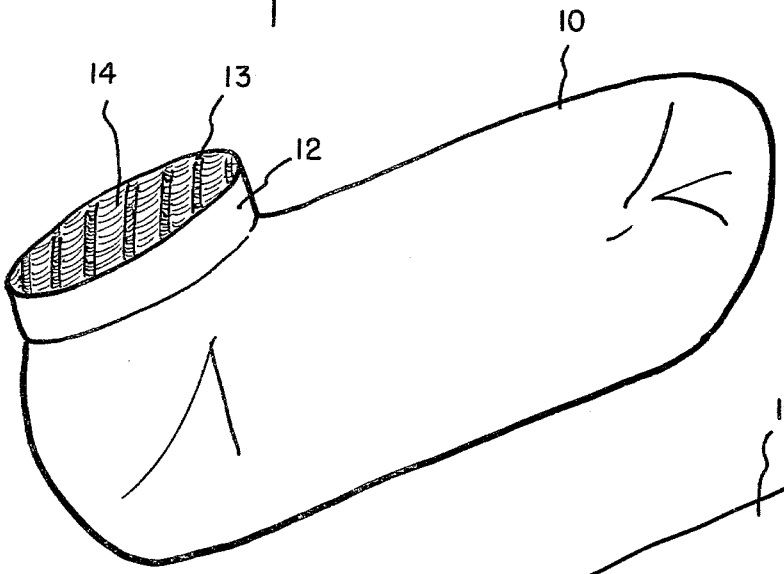
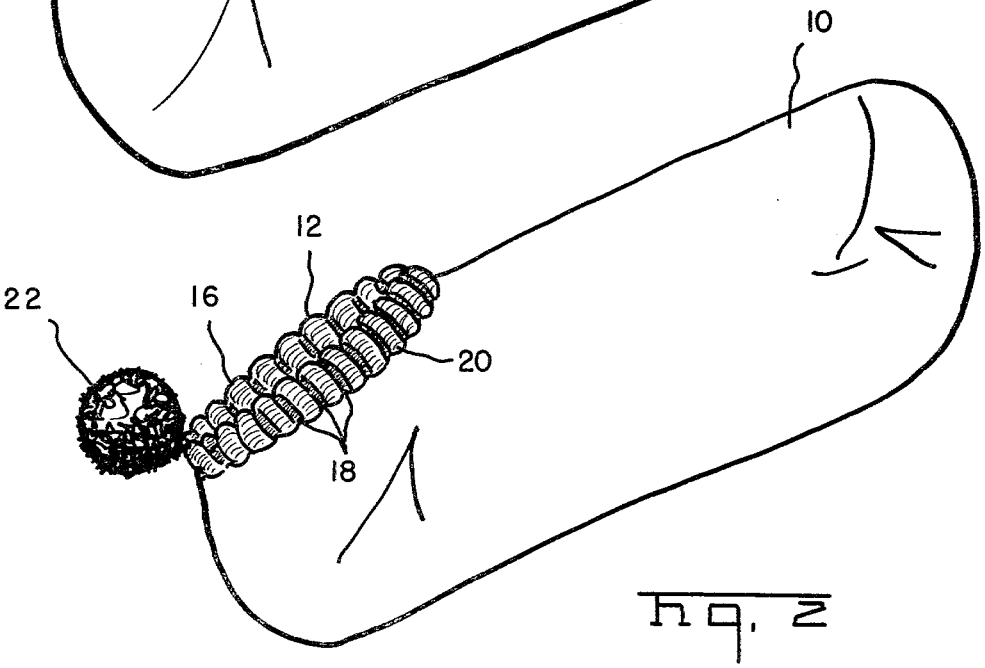
Fig. 2

DECORATIVE FOOTLET-TYPE SOCK

During the last several years, the low cut or footlet-type athletic sock has become quite popular, especially amongst lady golfers and tennis players. While male athletes also utilized the footlet-type sock in recent years, the demand for decorative type footlets is not as great with males as with females. The footlets for female athletes have included several types of unique decorations around the top. Some have included ribbons around the upper edge or welt, some have included pom-poms at the rear thereof, and some have included a combination of both.

U.S. Pat. No. 3,274,804 to Thornburg et al describes and illustrates such a sock that has a roll top with terry loops on the inside in which a gear and foward tab are knit, and several strands of elastic are applied in the upper edge thereof to cause the tabs to roll down upon themselves when put on the foot of the wearer. Such products have been generally acceptable, however, are open to objection in that the front roll down portion tends to work beneath the tongue of the shoe where its thickness causes discomfort to the wearer. The U.S. Pat. to Nester No. 3,990,115 is illustrative of an improvement on the earlier mentioned Thornburg et al patent in that the sides are tacked to better cause the front and rear portions to conform to the configuration of the shoe.

The present invention, on the other hand is directed to a footlet-type sock having a unique decorative exposed surface which is scalloped, ribbed, fluted, or of high relief appearance. The ribs or flutes are formed on the inner, upper welt surface of the sock, so that when the welt is rolled over and tacked or transferred down the ribs are exposed forming a decorative edge. The welt area includes courses of both an elastic yarn and a synthetic or natural yarn knitted in plated relationship. The elastic yarn tends to bulk up the synthetic yarn causing an even higher relief area in the rib portion than would normally be expected. In other words, the ribs, which extend vertically or walewise, are relatively wide having a bulky appearance when compared to the low relief areas therebetween.

In forming the sock in such a manner knitting is begun by laying in a few courses of an elastic yarn, then the welt area is formed in which both an elastic yarn and a synthetic or natural yarn are knitted together in plated relationship and introduced at the same point, but through different feed fingers as is conventional in plating techniques. Each course in the welt portion comprises wales of conventional knit stitches, separated by at least two wales in which the yarn is floated past the needles. The pattern may be two knit stitches followed by two float stitches and repeated all the way around the course; it may be one knit stitch followed by two float stitches; it may be one or two knit stitches followed by three float stitches or any other similar type arrangement. The important thing is that the combination of the knit stitches with the elastic yarn therein causes the float stitches to bulk excessively and form the high relief flutes or scallops. In such an arrangement even where the knitting procedure is two knit stitches followed by two float stitches, the final appearance will be that the high relief area formed by the floats will be relatively wide compared to the width of the low relief areas formed by the knit stitches.

It is therefore an object of the present invention to provide a footlet-type sock with a unique decorative exposed surface.

It is another object of the present invention to provide a footlet-type sock in which the exposed surface includes at least a portion thereof formed of a plurality of wide high relief vertical ribs separated by relatively narrow, low relief grooves.

Other objects and a fuller understanding of the present invention will become apparent upon reading the following detailed description of a preferred embodiment along with the accompanying drawings in which:

FIG. 1 is a perspective view of a footlet-type sock formed according to the present invention with the welt area upstanding from the sock to show that the high and low relief areas appear on the inner surface thereof;

FIG. 2 is a perspective view, similar to FIG. 1, except showing the sock in its final form; and FIG. 3 is a stitch diagram of the welt area of the sock showing the technique by which the decorative fluted surface is formed.

DETAILED DESCRIPTION OF A PREFERRED EMBODIMENT

Figure 7:
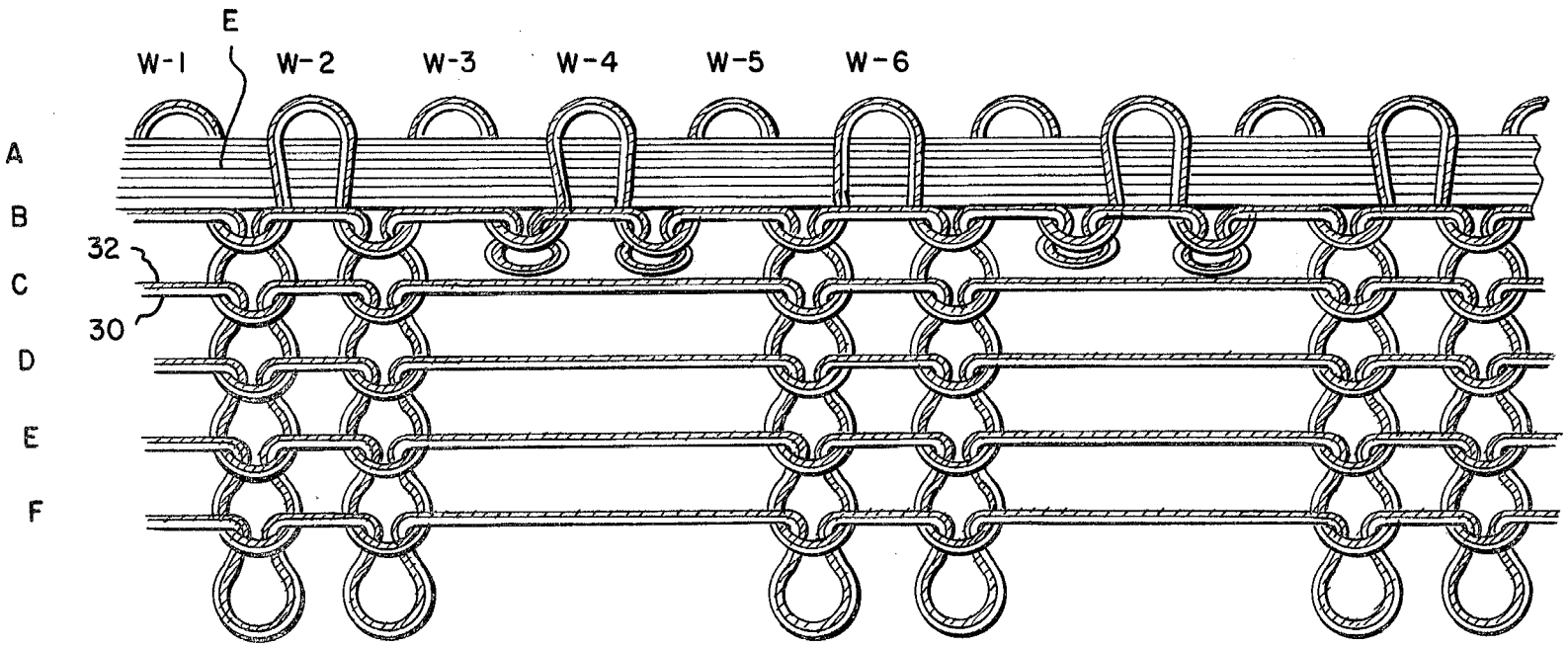

Turning now to the drawings, and particularly to FIGS. 1 and 2, there is illustrated a low cut or footlet-type sock 10 of the type with which the present invention is concerned. Such socks include a welt portion 12 which is initially formed and includes an opening 14 through which the foot of the wearer is inserted to emplace the sock on its foot. FIG. 1 is illustrative of a sock with the welt turned up, which would only occur if the transfer stitches holding the upper edge 13 of the welt 14 down onto the sock portion were cut and the welt rolled up. In this regard, FIG. 1 is for the purpose only for showing that the high and low relief areas of the welt 12 are formed on the inside surface of the welt during knitting so that when the welt is turned down and tacked or transferred there results a sock 10 with the appearance of FIG. 2.

In general the welt area 12 as illustrated in FIG. 2 is formed of a plurality of ribs, flutes, scallops 16 which give the appearance of high and low relief. The high relief areas or flutes 16 are separated by the low relief portions 18. As can be seen in FIG. 2, the high relief ribs 16 are relatively wide as compared to the separating or low relief ribs 18, even though in forming the stocking as will be described hereinbelow the number of wales in each portion may be the same.

In samples of socks formed in which the wales in the low relief ribs 18 are identical in number with the wales in high relief ribs 16, the wide bands formed by the high relief ribs 16 give the appearance of being two to three times as wide as the low relief areas because of the unique construction which tends to bulk the high relief areas. Either in the construction of the stocking 10 or subsequent thereto, the upper edge 13 of the welt 12 is turned down and tacked into the sock along line 20. This may be accomplished by transfer knitting in a well-known technique, or by tacking separately on a sewing machine. If desired, a pom-pom 22 may be attached to the rear of the opening 14 upon completion of the sock to give further decorative characteristics; however, the pom-pom is not required and does not form a portion of the present invention.

Turning now to FIG. 3 and the method of construction, it can be seen that construction is initially started by laying in an initial course A or make-up course by feeding in elastic yarns E to every other needle while being floated inside of the remaining needles during several rotations of the needle cylinder. The body yarn 30 and the elastic yarn 32 in an initial course is then fed to and form stitch loops on every needle so that adjacent stitch loops are formed in course A on opposite sides of the inlaid elastic yarns E. During the next rotation of the needle cylinder (course B) both the body yarn 30 and the elastic yarn 32 are fed to every needle to tie in the body yarn 30 and the elastic yarn 32 which surrounds the elastic strands E. Moving now to course C, the normal knitting of the welt area begins in which, in one embodiment, both the body yarn 30 and the elastic yarn 32 are formed into knit stitches in wales W-1 and W-2, then floated for the next two successive wales W-3, W-4, then knit again in wales W-5, W-6. This construction continues around in the area of the welt 12. During formation of the welt area, the elastic or rubber yarn is kept under a slightly greater tension than normal to accentuate the bulk appearance of the high relief ribs 16. The tension is relaxed at the bottom end of the welt area for a few courses (preferably 4) so that the rubber will not retract after it is cut. Course C is duplicated for a prescribed number of courses to form the welt 12, whereupon the first course, which has been held on the transfer needles is transferred down and into the stocking along line 20 (FIG. 2). The elastic yarns E help to roll the edge down and hold it in position. The remainder of the sock is then finished with the heel and toe portions being formed and the toes being closed in accordance with any known conventional techniques.

While the footlet illustrated and described hereinabove has been disclosed as extending entirely around the top opening, it is apparent that the construction could be formed partially around the opening, with any other type of construction or even a plain upper edge forming the remainder thereof. Also, while the construction shown in FIG. 3 illustrates the scalloped area being formed a plurality of courses in which two consecutive wales are knit and cast off followed by two consecutive wales which are floated, then is repeated over and over, it is apparent that the same or similar result would be reached if one wale were knit followed by two or three wales of floats, or three wales were knit followed by two or three wales of floats, or any other combination of knits and floats.

While a preferred embodiment of the present invention has been described in detail hereinabove it is apparent that various modifications and changes might be made without departing from the scope of the invention which is set forth in the accompanying claims.

What is claimed is:

1. A knit, low-cut, footlet-type sock adapted to be worn inside a low-cut shoe and substantially covered thereby with the exception of an exposed decorative welt, said welt comprising:

(a) a scalloped surface extending around at least a portion of said welt;

(b) said scalloped surface comprising:

(i) a plurality of courses formed of two yarns only, one being an elastic yarn and the other a body yarn, the two yarns being knit in plated relationship;

(ii) each of said courses including two knit stitches separated by a band of at least two adjacent float stitches;

(c) the combination of said elastic yarn and said knitting construction causing relatively wide bands or walewise ribs of raised fabric separated by a relatively narrow band of base fabric extending through the length of said welt;

(d) said scalloped surface being formed on the inside of said welt, and the welt being rolled over and tacked down to expose the scalloped surface on both the inside and outside of the exposed upper edge of the sock.

2. A method for forming a knit, low-cut, footlet-type sock with an exposed decorative welt comprising the steps of:

(a) laying in a plurality of strands of elastic material, knitting at least one course to tie in said elastic strands, and holding said strands and initial course on the transfer needles of the machine;

(b) forming a welt area by knitting a plurality of courses of two yarns only, first an elastic yarn under tension and second a body yarn, the two yarns being knit in plated relationship;

(c) at least a portion of each course including two knit stitches, in which loops are formed on the needles and cast off, separated by at least two adjacent wales of float stitches formed on the inside surface of said fabric;

(d) folding over the welt portion and transferring the initial course of said welt area into the bottom course to form an upper decorative edge; and (e) knitting the remainder of the heel, foot, and toe portions of the sock according to conventional techniques.

* * * * *